US011314269B2

(12) United States Patent
Kimura

(10) Patent No.: US 11,314,269 B2
(45) Date of Patent: Apr. 26, 2022

(54) ELECTRONIC CIRCUIT FOR VOLTAGE REGULATION

(71) Applicant: Morse Micro PTY. LTD., Surry Hills (AU)

(72) Inventor: Hiroyuki Kimura, Sydney (AU)

(73) Assignee: Morse Micro PTY. LTD., Surry Hills (AU)

( * ) Notice: Subject to any disclaimer, the term of this patent is extended or adjusted under 35 U.S.C. 154(b) by 0 days.

(21) Appl. No.: 17/164,000

(22) Filed: Feb. 1, 2021

(65) Prior Publication Data

US 2021/0240212 A1 Aug. 5, 2021

Related U.S. Application Data

(60) Provisional application No. 62/967,660, filed on Jan. 30, 2020.

(51) Int. Cl.
*G05F 1/575* (2006.01)
*G05F 1/571* (2006.01)

(52) U.S. Cl.
CPC ..... *G05F 1/575* (2013.01); *G05F 1/571* (2013.01)

(58) Field of Classification Search
None
See application file for complete search history.

(56) References Cited

U.S. PATENT DOCUMENTS 5,311,115 A * 5/1994 Archer ..... H01L 27/0883 323/315
6,518,737 B1 * 2/2003 Stanescu ..... G05F 1/575 323/280
6,975,494 B2 * 12/2005 Tang ..... H02M 3/1584 361/64
8,344,713 B2 * 1/2013 Shrivas ..... G05F 1/575 323/273
8,648,578 B2 * 2/2014 Zhao ..... G05F 1/571 323/226
9,261,892 B2 * 2/2016 Wang ..... G05F 1/575
9,323,264 B2 * 4/2016 Huang ..... G05F 1/575
9,454,166 B2 9/2016 Liu
(Continued)

OTHER PUBLICATIONS

Manda, Mahender et al., "A Multi-Loop Low Dropout FVF Voltage Regulator with Enhance Load Regulation", Invited Paper, 2017, New Mexico State University Klipsch School of Electrical and Computer Engineering, NM 88003, USA.
(Continued)

*Primary Examiner* — Thomas J. Hiltunen
(74) *Attorney, Agent, or Firm* — CP Law Group PC; Cy Bates

(57) ABSTRACT

An electronic circuit for voltage regulation is disclosed, the circuit generally includes a low-dropout (LDO) voltage regulator function block, including a primary feedback loop, and an output voltage stabilizer block connected to the LDO voltage regulator function block outside the primary feedback loop, wherein the output voltage stabilizer block includes a plurality of peak voltage suppression circuits and a plurality of dip voltage suppression circuits. In some embodiments, the output voltage stabilizer block is set at low bias current to minimize current consumption at normal condition. Other useful features and advantages of an electronic circuit for voltage regulation are disclosed.

15 Claims, 8 Drawing Sheets

(56) References Cited

U.S. PATENT DOCUMENTS

| | | | | |
|---|---|---|---|---|
| 10,001,795 | B2 * | 6/2018 | Jefremow | H02M 3/155 |
| 10,216,209 | B1 * | 2/2019 | Ham | G05F 1/59 |
| 10,382,030 | B2 * | 8/2019 | Chellamuthu | G05F 1/56 |
| 10,386,877 | B1 | 8/2019 | Magen | |
| 10,613,566 | B2 * | 4/2020 | Lim | G05F 1/575 |
| 10,996,700 | B1 * | 5/2021 | Tan | G05F 1/569 |
| 11,137,785 | B2 * | 10/2021 | Chang | G11C 5/147 |
| 2015/0188408 | A1 * | 7/2015 | Huang | H02M 3/156 323/272 |

OTHER PUBLICATIONS

Moon, Junil et al, "Design of low-power fast-transient-response, capacitor-less low dropout regulator for mobile applications", Letter, Nov. 17, 2016, IEICE Electronics Express, vol. 13 No. 23, 1-6, USA.

Milliken, Robert Jon, "A Capacitor-Less Low Drop-Out Voltage Regulator With Fast Transient Repsonse", Thesis, Texas A&M, Dec. 2005, USA.

* cited by examiner

ELECTRONIC CIRCUIT FOR VOLTAGE REGULATION

TECHNICAL FIELD

The disclosure relates to electronic circuits for voltage regulation; and more particularly, to a NMOS capless low dropout voltage regulator with output stabilizer.

BACKGROUND ART

With the advent of portable electronic devices comes a need for voltage regulation circuits, such as, without limitation, low dropout (LDO) voltage regulator circuits, otherwise known as "LDO voltage regulators". LDO voltage regulators are often used in the final stage between a power supply and a user device to apply constant voltage. The dropout voltage between the input and output should be as small as possible to reduce power dissipation, while large dropout is better for regulation control. LDO voltage regulators must maintain output voltage with a wide range of load current. Load transient characteristic is an important factor for LDOs because any change in the output voltage may cause modulation of the signal in the user device, even in digital circuits.

Conventional LDO voltage regulator circuits may employ a series pass transistor, a differential error amplifier, a precise voltage reference and a compensation circuit. More recently, capacitor less (capless) LDO voltage regulators have been proposed for certain applications. A review of LDO voltage regulator circuits is described by Milliken, Robert Jon, 2005.

SUMMARY OF INVENTION

Technical Problem

There is a present and ongoing need for compact capless LDO voltage regulator circuits with improved efficiency and minimized load transient for use, inter alia, in modern digital circuits and corresponding devices.

Solution to Problem

In accordance with various embodiments described herein, an electronic circuit for voltage regulation is disclosed, the circuit comprises a low-dropout (LDO) voltage regulator function block and an output voltage stabilizer block. The LDO voltage regulator function block generally includes: a transconductance stage configured as an error amplifier, a buffer stage, an NMOS output stage and a primary feedback loop. The output voltage stabilizer block is connected to the LDO voltage regulator function block outside the primary feedback loop, and includes a plurality of peak voltage suppression circuits and a plurality of dip voltage suppression circuits. With the use of both peak- and dip-voltage suppression circuits the electronic circuit for voltage regulation is effective at the voltage output independently of peak or dip effect.

In some embodiments, the output voltage stabilizer block is set at low bias current to minimize current consumption at normal condition.

In some embodiments, the output stage comprises a power MOSFET selected from the group consisting of: a native-type MOSFET and a depletion-type MOSFET.

In some embodiments, the output stage comprises a power MOSFET as above, and further comprises a supply node (Vdd) and a power switch, wherein the power switch is disposed between the supply node and the power MOSFET. In this regard, the power switch is configured to turn off the power MOSFET under certain conditions.

Illustrative examples are described herein and are not intended to be limiting in scope, but rather are provided for illustrating various circuit topologies for implementing embodiments according to the claimed invention.

Advantageous Effects of Invention

An electronic circuit for voltage regulation in an embodiment as described herein, namely, one in an embodiment having an output voltage stabilizer block connected to the LDO voltage regulator function block outside the primary feedback loop, is adapted to eliminate influence of the output voltage stabilizer block on the LDO voltage regulator function block phase margin. Even if there was an interaction between the LDO voltage regulator function block and the voltage stabilizer block, the voltage stabilizer block is configured to correct output voltage error before the LDO voltage regulator function block reacts.

Another benefit of an electronic circuit for voltage regulation in an embodiment as described herein, namely, one in an embodiment having distinct and separate peak- and dip-voltage suppression circuits, is the ability of the circuit to regulate voltage effectively at output voltage peak and dip.

As compared to other LDO voltage regulator circuits, namely, those with multiple feedback loops and load regulation (see, for example, Mahender Manda et al, 2017), the electronic circuit for voltage regulation as described herein is relatively compact and stable.

There are several types of pulsive noise. At least as already mentioned, there are 2 kinds of suppression circuits for peak and dip due to different directions. Noise may come from the supply, ground, or its load. Each noise has its strength and speed. A perfect noise suppression circuit can work as expected, but in reality, each type of circuit has its own characteristics so multiple peak and dip suppression circuits are better for the simultaneous noise types. A primary advantage of the electronic circuit for voltage regulation as described herein is attenuated load transient response.

BRIEF DESCRIPTION OF DRAWINGS

The embodiments of the disclosure will be more fully understood from the following detailed descriptions, taken together with the drawings in which.

DESCRIPTION OF EMBODIMENTS

Figure 1:
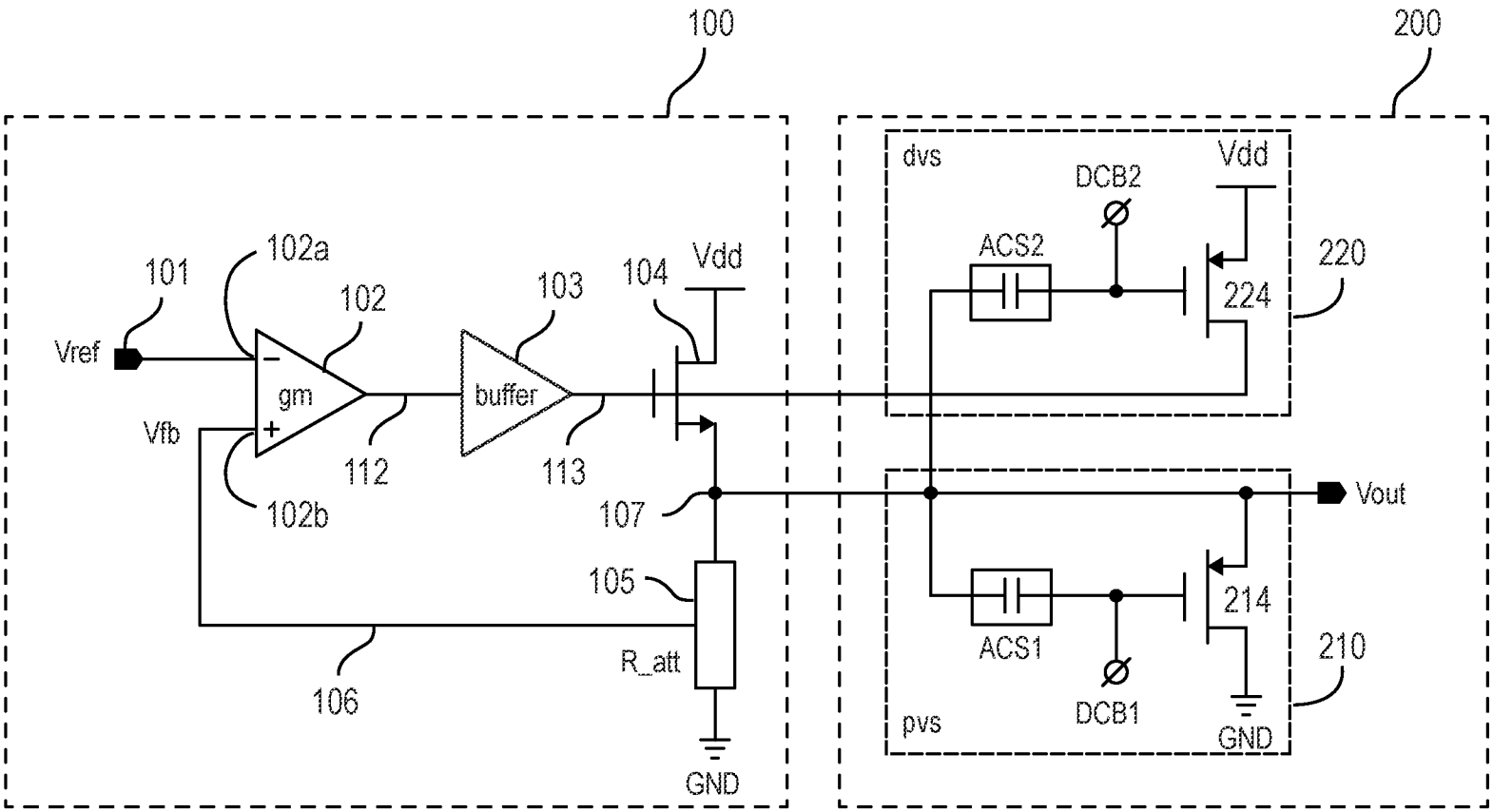
FIG. 1 shows a block diagram of an electronic circuit for voltage regulation according to a first illustrated embodiment ("general embodiment").

Embodiments disclosed herein provide improved circuits, systems, chips, components, and methods for voltage regulation. The disclosure provides techniques for mitigation and improved recovery of voltage regulators from output voltage changes that may occur, for example, by sudden changes in load conditions. The disclosed techniques are effective for maintaining a constant output voltage at a final stage between a power supply and a user device.

Although specific advantages have been enumerated above, various embodiments may include some, none, or all the enumerated advantages.

Other technical advantages may become readily apparent to one of ordinary skill in the art after review of the following figures and description.

Unless specifically defined herein, all terms are intended to be interpreted according to the plain and ordinary meaning as would be understood by one having skill in the art taking into consideration this disclosure as a whole, including the claims and the drawings.

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Example 1

Now turning to the drawings and a first illustrated example thereof, FIG. 1 shows a block diagram of an electronic circuit for voltage regulation according to one general embodiment.

In the general embodiment, the electronic circuit for voltage regulation comprises two functional blocks, including: a low-dropout (LDO) voltage regulator function block (100), and an output voltage stabilizer block (200). As further shown, the LDO voltage regulator function block comprises, inter alia, a primary feedback loop (106) and an output voltage stabilizer block connected to the LDO voltage regulator function block outside the primary feedback loop. Moreover, the output voltage stabilizer block comprises a peak voltage suppression circuit (210) and a dip voltage suppression circuit (220).

In certain variations of the general embodiment, it may be preferred that the output voltage stabilizer block is set at low bias current to minimize current consumption at normal condition.

The LDO voltage regulator function block is shown comprising: a reference node (101) configured to receive a reference voltage (Vref), a transconductance stage (gm, 102) coupled to the reference node at the inverting input (102*a*) and comprising a transconductance stage output (112), a buffer stage (103) coupled to the transconductance stage output and comprising a buffer stage output (113), an output stage (104) coupled to the buffer stage output, an output node (107) configured to provide an output voltage (Vout), a feedback resistor network (R_att, 105) and feedback loop (106) coupled between the output node and the non-inverting input (102*b*) of the transconductance stage and configured to provide a feedback voltage (Vfb) to the transconductance stage. The output stage is further coupled to supply node (Vdd) as shown.

The transconductance stage is provided as an error amplifier in the embodiment of FIG. 1.

Here, the output stage is illustrated as a single field-effect transistor (FET). In some embodiments, the single FET comprises an n-channel metal-oxide-semiconductor (NMOS). In certain embodiments, the single FET comprises a power MOSFET, and preferably a native- or depletion-type power MOSFET. However, alternatively, the output stage may comprise a class-B or class-C push-pull stage instead of a single FET to prevent excessive high output voltage at low output current.

The output stabilizer block comprises one or a plurality of peak (or positive pulse) suppression circuits, and one or a plurality of dip (or negative pulse) suppression circuits. The general embodiment of FIG. 1 illustrates a single peak voltage suppression circuit (210) and a single dip voltage suppression circuit (220); however, as will be illustrated in other examples, below, the output stabilizer block may preferably comprise a plurality of dip suppression circuits and/or peak suppression circuits.

The peak voltage suppression circuit (210) is shown comprising a first suppression current generator (214) connected to a low side of the output stage (output node, 107), and further comprises a first AC coupling (ACS1) configured to sense voltage change, and a first DC bias (DCB1) coupled to the first suppression current generator.

Resident within the dip voltage suppression circuit (220) is a second suppression current generator (224) connected between the supply node (Vdd) and the buffer stage output (113), and further comprises a second AC coupling (ACS2) to sense voltage change, and a second DC bias (DCB2) coupled to the second suppression current generator.

One having skill in the art will appreciate certain variations and modifications to the illustrated general embodiment, wherein any of a myriad of possible circuits can be particularly designed, for example and not limitation, various modifications providing an output voltage stabilizer block with one peak voltage suppression circuit and a plurality of dip voltage suppression circuits, one dip voltage suppression circuit and a plurality of peak voltage suppression circuits, or a plurality of dip voltage suppression circuits and a plurality of peak voltage suppression circuits, with the output voltage stabilizer block (200) being connected to the LDO voltage regulator function block (100) outside the primary feedback loop.

Example 2

Figure 2:
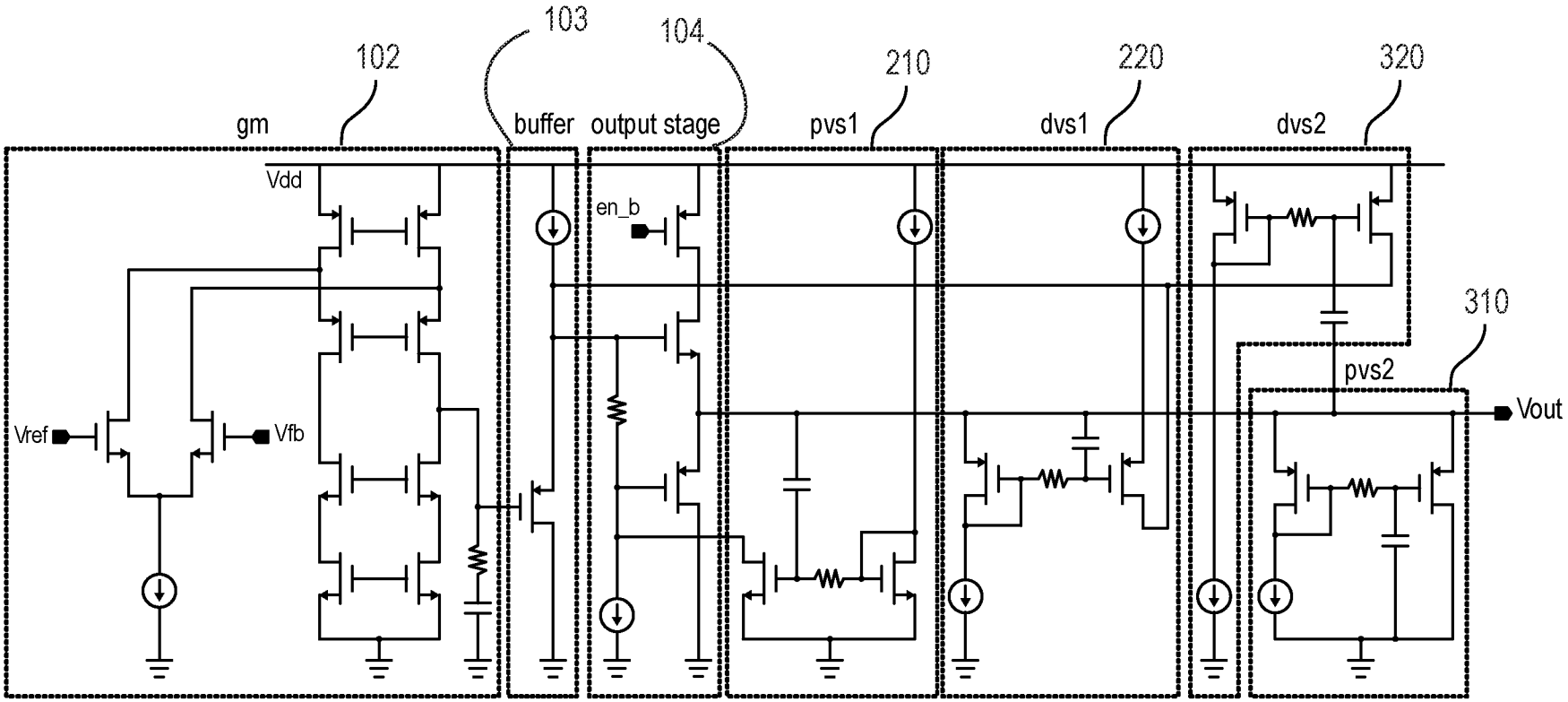
FIG. 2 shows a circuit diagram of an electronic circuit for voltage regulation according to a second illustrated embodiment.

In a second example, FIG. 2 shows a circuit diagram of an electronic circuit for voltage regulation according to a second illustrated embodiment.

Here, the electronic circuit comprises much of the same structure as that of the general embodiment, above, but with a plurality of peak voltage suppression circuits and a plurality of dip voltage suppression circuits. Specifically, the electronic circuit for voltage suppression according to the second illustrated embodiment comprises a transconductance stage (102) coupled to a buffer stage (103), the buffer stage being coupled to an output stage (104), and the output stage coupled to an output voltage stabilizer block. The output voltage stabilizer block comprises first and second peak suppression circuits (pvs1 and pvs2, respectively), and a plurality of dip suppression circuits, including first and second dip suppression circuits (dvs1 and dvs2, respectively). While an output voltage stabilizer block with two peak suppression circuits and two dip suppression circuits is illustrated, it would be recognized by one having skill in the art that three or more peak suppression circuits and/or three or more dip suppression circuits may be similarly implemented.

FIGS. 3-7 show detailed circuit diagrams of each of the output stage, first and second peak suppression circuits, and first and second dip suppression circuits of FIG. 2.

Figure 3:
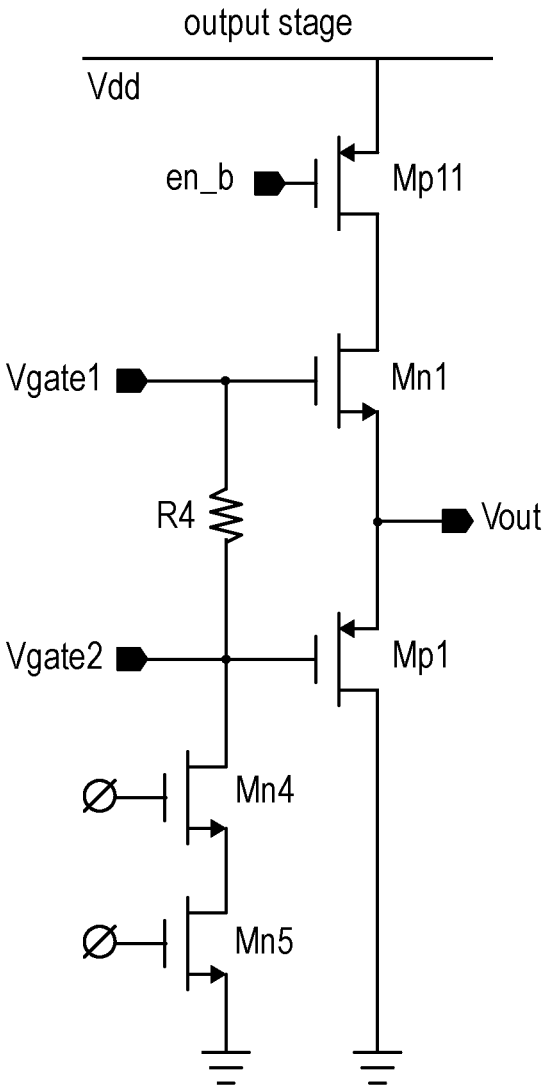
FIG. 3 shows a circuit diagram of an output stage according to the second illustrated embodiment.

Turning to FIG. 3, the output stage of the electronic circuit for voltage regulation is shown in further detail. Transistor Mn1 comprises an output power NMOS transistor, working as a source follower. The gate of transistor Mn1, Vgate1 node, is controlled by the buffer stage (see FIG. 2). The source of Mn1 is connected to Vout. Transistor Mp11 works as a power switch, making off leak current lower, especially effective when transistor Mn1 is a native- or depletion-type FET. En_b is the device enable input, effectively turning 'on' or 'off' the power switch Mp11. Transistor Mp2 (See FIG. 6) works as a push-pull output stage with transistor Mn1, and provides over voltage suppression in DC and AC. Transistors Mn4 and Mn5 generate a constant current, this constant current through resistor R4 defines a DC operating point of transistors Mn1 and Mp1. The bias point is dependent on the requirement, but to minimize quiescent current, a class-B or class-C operating is selected.

Notwithstanding that illustrated in FIG. 3, some embodiments provide that the electronic circuit for voltage regulation may comprise supply node (Vdd) and a power switch, wherein the power switch is disposed between the supply node and the power MOSFET. In these embodiments, the power switch is arranged to facilitate switching the power MOSFET between 'on' and 'off' states. In certain embodiments, the power switch is disposed between the supply node and an NMOS coupled to the buffer stage.

In certain embodiments the output stage may comprise a push-pull output stage.

In other embodiments, a single output transistor or a network of transistors may be implemented in a manner similar to that shown in FIGS. 1 to 3.

Figure 4:
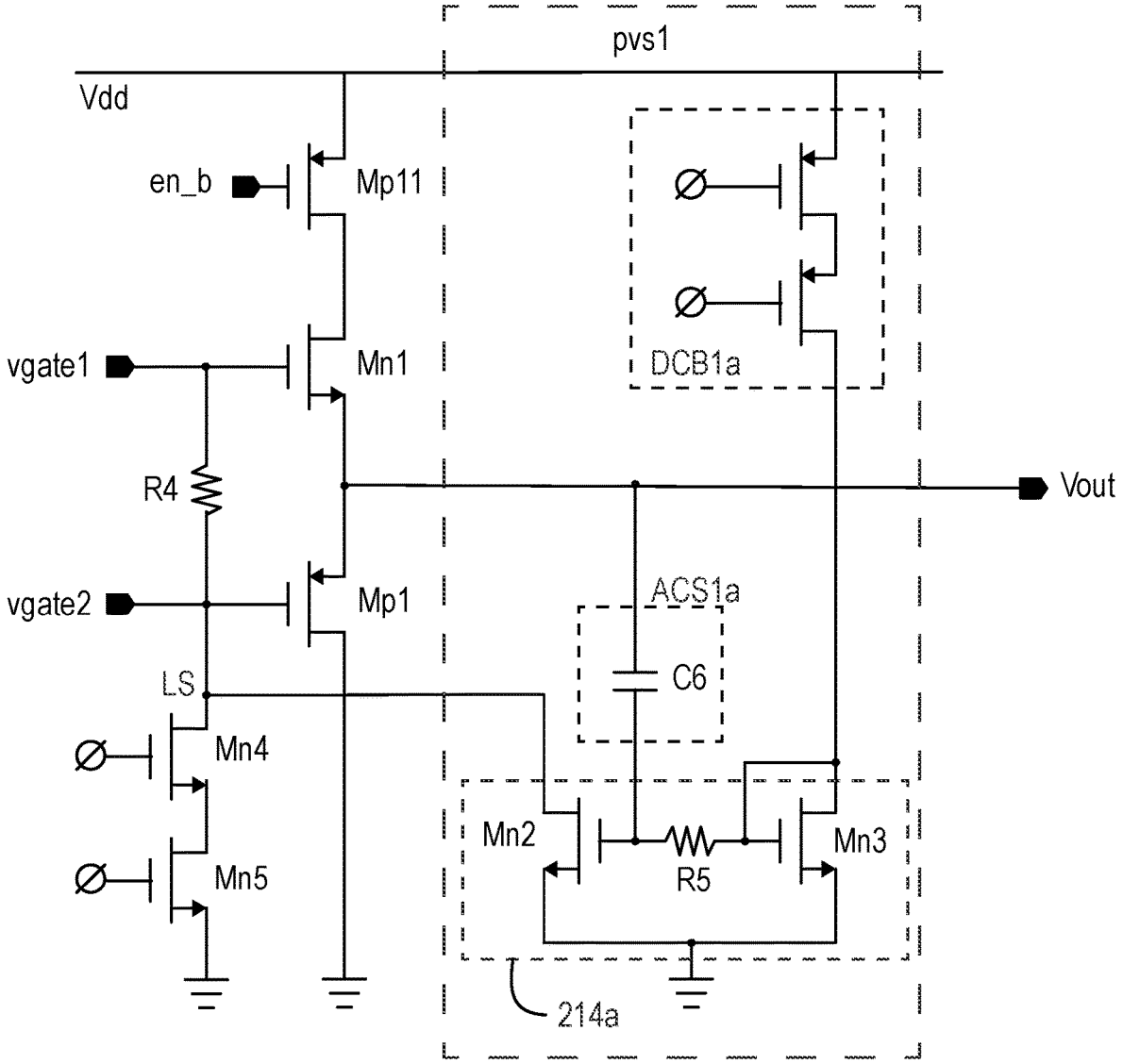
FIG. 4 shows a combination of the output stage of FIG. 3 and a first peak suppression circuit of an output voltage stabilizer block according to the second illustrated embodiment.

FIG. 4 shows a combination of the output stage of FIG. 3 and a first peak suppression circuit of an output voltage stabilizer block according to the second illustrated embodiment. Current through transistor Mn3 with resistor R5 gives a DC operating point of transistor Mn2. When Vout increases, Mn2 gate also increases through capacitor C6, which increases drain current of transistor Mn2 then increases voltage across resistor R4. Node Vgate1 is a lower impedance node compared to Vgate2 node, thus voltage at Vgate2 drops more to go down Vout by the Mp1 source follower. This stabilizing reaction is much faster than over all LDO feedback control. There is no affection to the main feedback stability of the LDO. This function is common for either voltage stabilizer circuit following.

Figure 5:
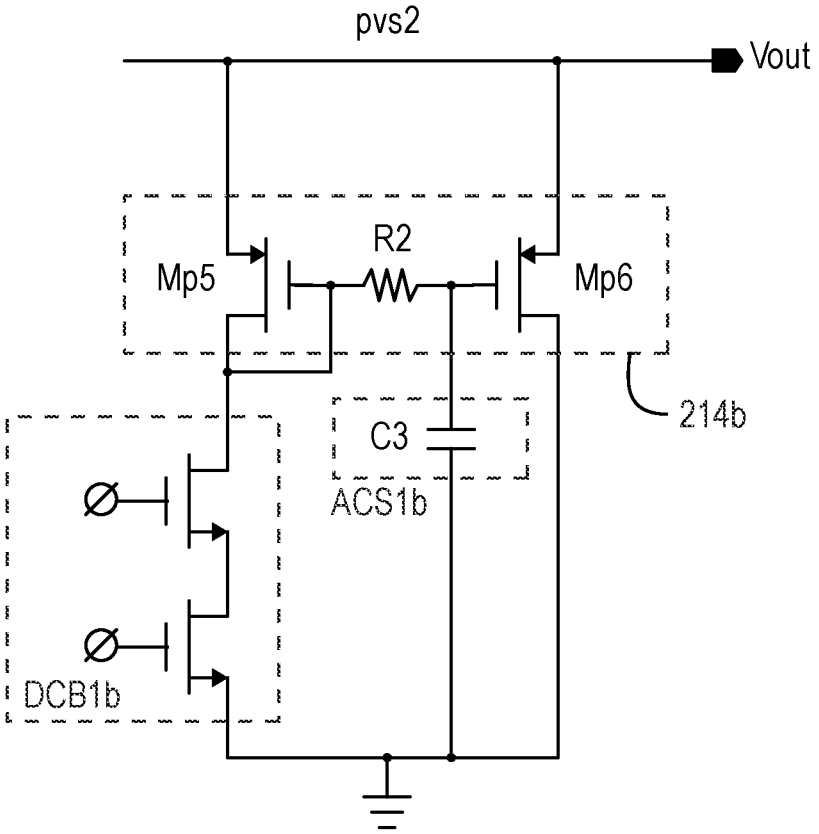
FIG. 5 shows a second peak suppression circuit of an output voltage stabilizer block according to the second illustrated embodiment.

FIG. 5 shows a second peak suppression circuit of an output voltage stabilizer block according to the second illustrated embodiment. Here, current through transistor Mp5 with resistor R2 gives a DC operating point of transistor Mp6. When Vout increases, Mp6 source also increases, but its gate voltage does not change much due to shunt to ground through capacitor C3. This Vgs change generates pull-down current towards ground through transistor Mp6. According to the gm of Mp6, increasing voltage across source and gate of Mp6 creates additional source current, pulling down Vout node voltage goes towards ground.

Figure 6:
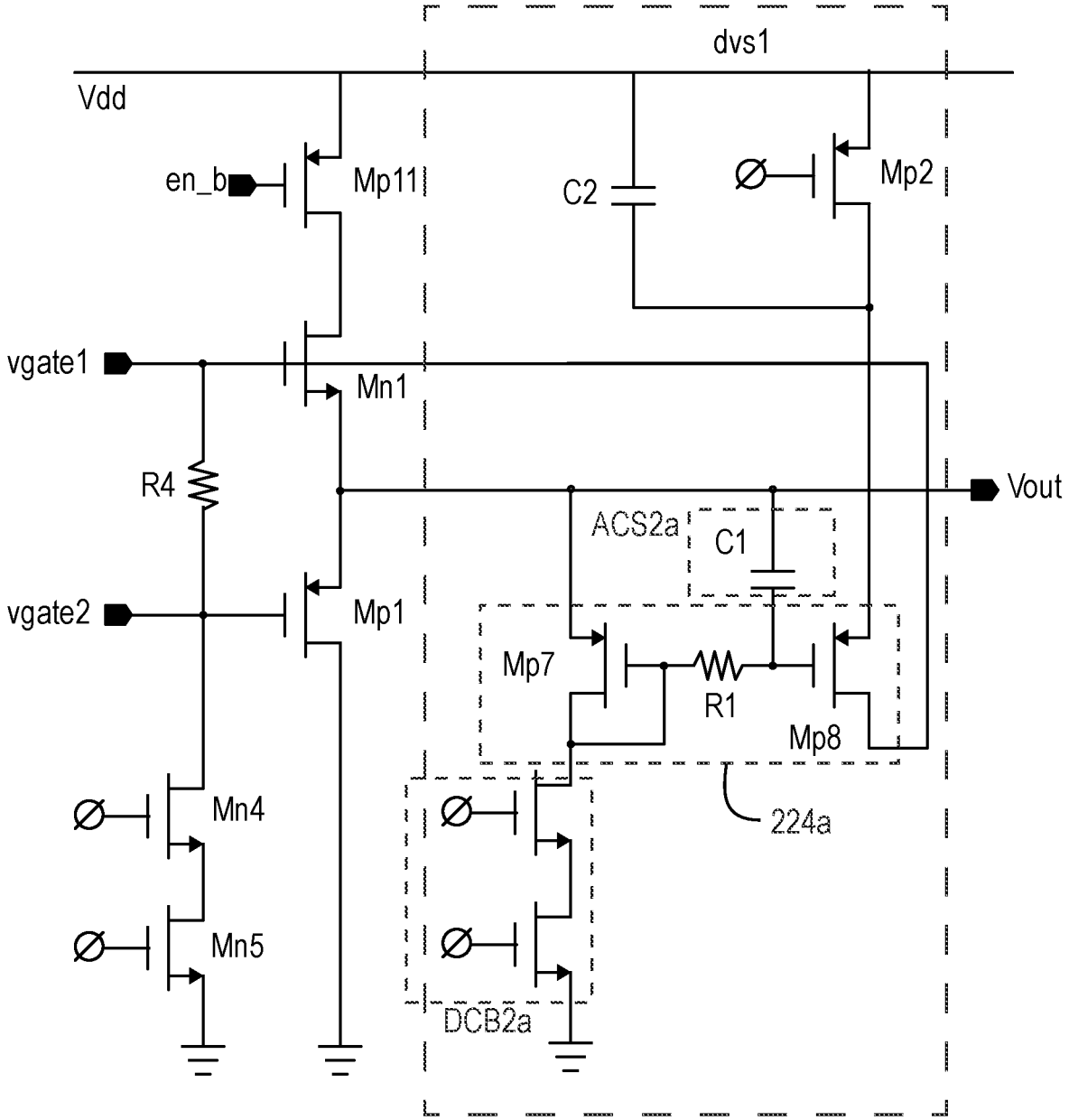
FIG. 6 shows a combination of the output stage of FIG. 3 and a first dip suppression circuit of an output voltage stabilizer block according to the second illustrated embodiment.

FIG. 6 shows a combination of the output stage of FIG. 3 and a first dip suppression circuit of an output voltage stabilizer block according to the second illustrated embodiment. Here, current through transistor Mp7 with resistor R1 gives a DC voltage to the gate of Mp8. An Mp8 bias operating point is defined by a constant current generated by transistor Mp2. If the current density of transistor Mp8 is the same as Mp7, Mp8 source will be close to Vout. When Vout decrease, the gate of transistor Mp8 also decreases through capacitor C1, but Mp8 source does not change much because of capacitor C2 and high slew rate of Vout. This Vgs change of Mp8 generates excessive current through transistor Mp8 and it pulls up Vgate1, which is connected to the output NMOS transistor Mn1. Since output NMOS transistor Mn11 gate increases, the output current increases and the Vout dip is suppressed.

Mp8 is driven by Vout though C1 so that C1 is better to be much larger than Cg of Mp8 (Cg8). High frequency voltage to current gain (GM8) from Vout to id of Mp8 is approximately gm of Mp8(gm8) times C1/(C1+Cg8). The cut off frequency (fc8) is gm8/(2 pi C2). Where C1=10 pF, Cg8=1 pF, C2=10 pF and gm8=100 uS, GM8=90.9 uS and fc8=1.59 MHz. To neglect impedance at the gate of Mp7, R1 should be larger than impedance of C1 at the cut off frequency. R1>1/(2 pi fc8 C1), By using the previous components values, R1 should be 10 kohm or larger.

Figure 7:
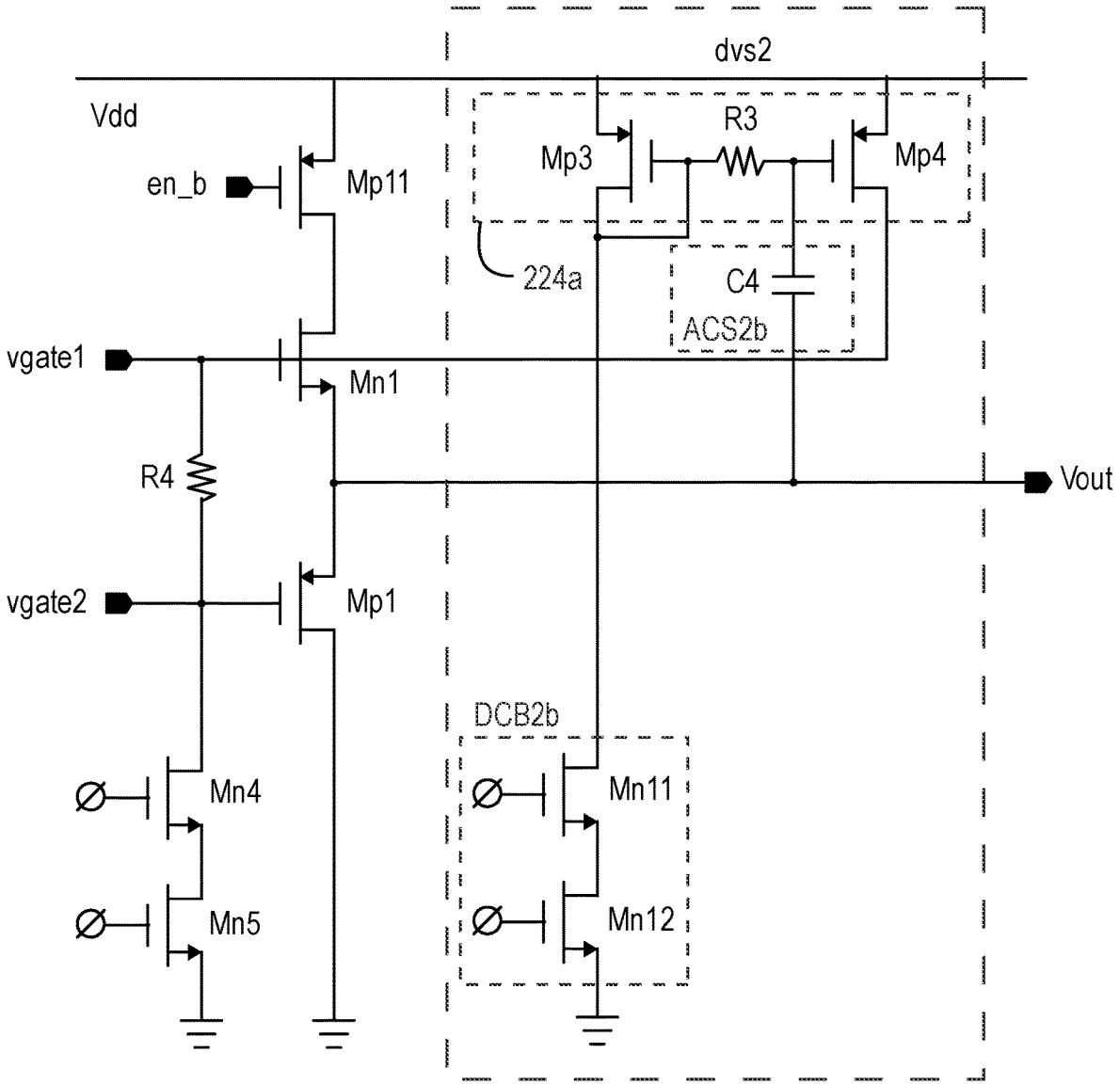
FIG. 7 shows a second dip suppression circuit of an output voltage stabilizer block according to the second illustrated embodiment.

FIG. 7 shows a combination of the output stage of FIG. 3 and a second dip suppression circuit of an output voltage stabilizer block according to the second illustrated embodiment. Here, current through transistor Mp3 with resistor R3 gives a DC operating point of transistor Mp4. When Vout decreases, Mp4 gate decreases through capacitor C4, which increases drain current of transistor Mp4 so that Vgate1 is pulled up towards Vdd and Vout. Transistor Mp4 could drive Vout directly, but a larger FET may be needed at Mp4 for high current. This indirect connection can save layout size.

Figure 8:
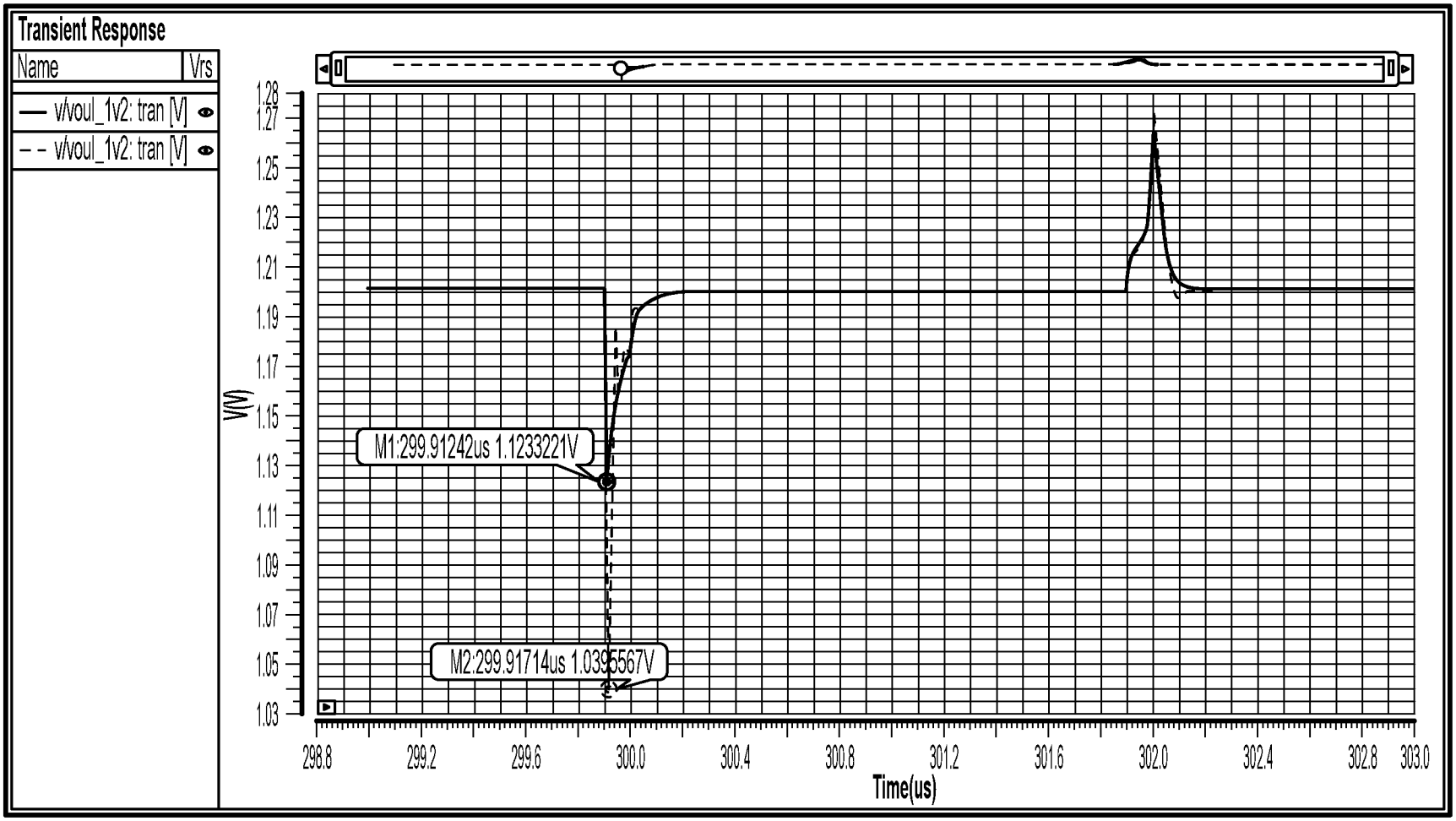
FIG. 8 shows a plot of transient response measured from the electronic circuit for voltage regulation of the second illustrated embodiment.

FIG. 8 shows a plot of transient response (Vout/time) measured from the electronic circuit for voltage regulation of the second illustrated embodiment. A first line (401) illustrates load regulation with the output stabilizer block according to the second illustrated embodiment. A second line (402) illustrates load regulation without the output stabilizer block. The peak and dip compensation are dependent on circuit tuning. The plot demonstrates that Vout peak improved by about 10 mV and Vout dip improved by about 83 mV when implementing the output stabilizer block. Thus, transient response is attenuated using the circuit with voltage stabilizer block as described herein.

Example 3

With the electronic circuit for voltage regulation according to any of the general embodiment or the second illustrated embodiment, or a variant thereof, a method for voltage regulation comprises attenuating transient load using one or more of the at least one peak voltage suppression circuit and the at least one dip voltage suppression circuit of the output voltage stabilizer block, wherein the output voltage stabilizer block is coupled to the LDO voltage regulator block outside the primary feedback loop.

Example 4

In yet another example, an integrated circuit (IC) can be manufactured using techniques known in the art, wherein the IC is configured to embody the electronic circuit for voltage regulation according the first and/or second illustrated embodiments as described herein, or any variation thereof as would be appreciated by one with skill in the art upon review of the instant disclosure.

Other Disclosure

Thus, in accordance with the disclosed examples and embodiments, and variations constructively disclosed herein according to the contemplation of one having skill in the art upon a review of the instant disclosure, the invention can be appreciated as an electronic circuit for voltage regulation, comprising: a low-dropout (LDO) voltage regulator function block comprising a primary feedback loop, and an output voltage stabilizer block connected to the LDO voltage regulator function block outside the primary feedback loop, wherein the output voltage stabilizer block comprises a plurality of peak voltage suppression circuits and a plurality of dip voltage suppression circuits.

In some embodiments, the output voltage stabilizer block is set at low bias current to minimize current consumption at normal condition.

In some embodiments, the LDO voltage regulator function block comprises: a reference node configured to receive a reference voltage, a transconductance stage coupled to the reference node at an inverting input thereof and comprising a transconductance stage output, a buffer stage coupled to the transconductance stage output and comprising a buffer stage output, an output stage coupled to the buffer stage output and comprising at least one output transistor, an output node configured to provide an output voltage, a feedback resistor network coupled between the output node and a reference ground, and the primary feedback loop, wherein the primary feedback loop is connected between the feedback resistor network and a non-inverting input of the transconductance stage.

In some embodiments, the output transistor comprises a power MOSFET. The output stage may further comprise a supply node and a power switch, wherein the power switch is disposed between the supply node and the power MOSFET. The power MOSFET may be one selected from the group consisting of: a native MOSFET and a depletion-type MOSFET. The power switch may be configured to switch the power MOSFET between 'on' and 'off' states. In some embodiments, the output stage comprises a push-pull output stage.

In some embodiments, the plurality of peak voltage suppression circuits may comprise a first peak voltage suppression circuit and a second peak voltage suppression circuit. Each of the first and second peak voltage suppression circuits may independently comprise: a suppression current generator, an AC coupling configured to sense voltage change, and a DC bias coupled to the suppression current generator. In some embodiments, the first peak voltage suppression circuit is configured with the suppression current generator thereof being connected to a low side of the output stage. In some embodiments, the second peak voltage suppression circuit is configured with the suppression current generator thereof being directly connected to the output node.

In some embodiments, the plurality of dip voltage suppression circuits comprises a first dip voltage suppression circuit and a second dip voltage suppression circuit. Each of the first and second dip voltage suppression circuits may independently comprise: a suppression current generator, an AC coupling configured to sense voltage change, and a DC bias coupled to the suppression current generator. In some embodiments, the first dip voltage suppression circuit is configured with the suppression current generator thereof connected between the supply node and the buffer stage output. In some embodiments, the second dip voltage suppression circuit is configured with an output of the suppression current generator thereof and an output of the AC coupling connected to the buffer output.

In another aspect, a method of voltage regulation, comprises: attenuating transient load with the plurality of peak voltage suppression circuits and the plurality of dip voltage suppression circuits.

In yet another aspect, an integrated circuit (IC) comprising an electronic circuit for voltage regulation according to the disclosure provided herein.

Unless otherwise specifically noted, information depicted in the drawings are not necessarily drawn to scale.

Modifications, additions, or omissions may be made to the systems, apparatuses, and methods described herein without departing from the scope of the disclosure. For example, the components of the circuits and systems may be integrated or separated. Moreover, the operations of the circuits and systems disclosed herein may be performed by more, fewer, or other components and the methods described may include more, fewer, or other steps. Additionally, steps may be performed in any suitable order. As used in this document, "each" refers to each member of a set or each member of a subset of a set.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

INDUSTRIAL APPLICABILITY

The disclosure is useful in the field of electronics, and more particularly, to electronic circuits for voltage suppression and corresponding devices implementing the same.

REFERENCE SIGNS LIST

AC coupling for sensing voltage change (ACS1*a*; ACS1*b*; ACS2*a*; ACS2*b*)
DC bias (DCB1*a*; DCB1*b*; DCB2*a*; DCB2*b*)
Ground (GND)
Supply node (Vdd)
low-dropout (LDO) voltage regulator function block (100)
reference node (101)
transconductance stage (102)
buffer stage (103)
output transistor (104)
feedback resistor network (105)
primary feedback loop (106)
output node (107)
output voltage stabilizer block (200)
peak voltage suppression circuit (210; 310)
suppression current generator (214*a*; 214*b*; 224*a*; 224*b*)
dip voltage suppression circuit (220; 320)

CITATION LIST

MAHENDER MANDA et al., "A Multi-Loop Low-Dropout FVF Voltage Regulator with Enhanced Load Regulation," 2017 IEEE 60th International Midwest Symposium on Circuits and Systems (MWSCAS), 2017, pp. 9-12, Boston, Mass. (https://ieeexplore.ieee.org/document/8052847)

JUNIL MOON et al., "Design of low-power, fast-transient-response, capacitor-less low-dropout regulator for mobile applications," IEICE Electronics Express, 2016, pp. 1-6, Vol. 13. Issue 23. (https://www.jstage.jst.go.jp/article/elex/13/23/13_13.20160882/article)

ON MAGEN, U.S. Pat. No. 10,386,877 B1, issued Aug. 20, 2019.

YONG FENG LIU, U.S. Pat. No. 9,454,166 B2, issued Sep. 27, 2016.

MILLIKEN, ROBERT JON, "A capacitor-less low drop-out voltage regulator with fast transient response," Master's thesis, Texas A&M University, December 2005. (http://hdl.handle.net/1969.1/3275)

What is claimed is:

1. An electronic circuit for voltage regulation, comprising:

a low-dropout (LDO) voltage regulator function block (100) comprising a primary feedback loop (106), and an output voltage stabilizer block (200) connected to the LDO voltage regulator function block outside the primary feedback loop comprising:

a reference node (101) configured to receive a reference voltage (Vref), a transconductance stage (102) coupled to the reference node at an inverting input (102*a*) thereof and comprising a transconductance stage output (112), a buffer stage (103) coupled to the transconductance stage output and comprising a buffer stage output (113), an output stage coupled to the buffer stage output and comprising at least one output transistor (104), an output node (107) configured to provide an output voltage (Vout), a feedback resistor network (105) coupled between the output node and a reference ground, and the primary feedback loop, wherein the primary feedback loop is connected between the feedback resistor network and a non-inverting input (102*b*) of the transconductance stage;

wherein the output voltage stabilizer block comprises a plurality of peak voltage suppression circuits (210; 310) and a plurality of dip voltage suppression circuits (220; 320) wherein said plurality of peak voltage suppression circuits comprises a first peak voltage suppression circuit (pvs1) and a second peak voltage suppression circuit (pvs2); and further wherein each of the first and second peak voltage suppression circuits independently comprises: a suppression current generator (214*a*; 214*b*), an AC coupling (ACS1*a*; ACS1*b*) configured to sense voltage change, and a DC bias (DCB1*a*; DCB1*b*) coupled to the suppression current generator.

2. The circuit of claim 1, wherein the output voltage stabilizer block is set at low bias current to minimize current consumption at normal condition.

3. The circuit of claim 1, wherein the output transistor comprises a power MOSFET.

4. The circuit of claim 3, the output stage further comprising a supply node (Vdd) and a power switch, wherein the power switch is disposed between the supply node and the power MOSFET.

5. The circuit of claim 3, wherein the power MOSFET is one selected from the group consisting of: a native MOSFET and a depletion-type MOSFET.

6. The circuit of claim 4, wherein the power switch is configured to switch the power MOSFET between 'on' and 'off' states.

7. The circuit of claim 1, wherein the output stage comprises a push-pull output stage.

8. The circuit of claim 1, wherein the first peak voltage suppression circuit is configured with the suppression current generator (214*a*) thereof being connected to a low side (LS) of the output stage.

9. The circuit of claim 1, wherein the second peak voltage suppression circuit is configured with the suppression current generator (214*b*) thereof being directly connected to the output node.

10. The circuit of claim 1, wherein said plurality of dip voltage suppression circuits comprises a first dip voltage suppression circuit (dvs1) and a second dip voltage suppression circuit (dvs2).

11. The circuit of claim 10, wherein each of the first and second dip voltage suppression circuits independently comprises: a suppression current generator (224*a*; 224*b*), an AC coupling (ACS2*a*; ACS2*b*) configured to sense voltage change, and a DC bias (DCB2*a*; DCB2*b*) coupled to the suppression current generator.

12. The circuit of claim 10, wherein the first dip voltage suppression circuit is configured with the suppression current generator (224*a*) thereof connected between the supply node (Vdd) and the buffer stage output.

13. The circuit of claim 12, wherein the second dip voltage suppression circuit is configured with an output of the suppression current generator (224*b*) thereof and an output of the AC coupling connected to the buffer output.

14. With the electronic circuit for voltage regulation according to claim 1, a method of voltage regulation, comprising:

attenuating transient load with the plurality of peak voltage suppression circuits and the plurality of dip voltage suppression circuits.

15. An integrated circuit (IC) comprising the electronic circuit for voltage regulation according to claim 1.

* * * * *